United States Patent [19]

Bagwell et al.

[11] 4,098,191

[45] Jul. 4, 1978

[54] PASSIVE OPTICAL PROXIMITY FUZE

[75] Inventors: Bryan G. Bagwell, Mesa; Frank S. Gemmell, Scottsdale, both of Ariz.

[73] Assignee: Motorola, Inc., Schaumburg, Ill.

[21] Appl. No.: 703,874

[22] Filed: Jul. 9, 1976

[51] Int. Cl.[2] ..... F42C 13/02; F42C 13/00; F42C 11/06

[52] U.S. Cl. ..... 102/213; 244/3.16; 102/215

[58] Field of Search ..... 102/70.2 P, 70.2 R; 244/3.16

[56] References Cited

U.S. PATENT DOCUMENTS

| | | | |
|---|---|---|---|
| 3,719,149 | 3/1973 | Masin | 102/70.2 R |
| 3,837,283 | 9/1974 | McCracken | 102/70.2 P |
| 3,843,076 | 10/1974 | King et al. | 244/3.16 |
| 4,010,689 | 3/1977 | Sochard et al. | 102/70.2 P |
| 4,022,132 | 5/1977 | Blomquist et al. | 102/70.2 P |

*Primary Examiner*—Samuel W. Engle
*Assistant Examiner*—Thomas H. Webb
*Attorney, Agent, or Firm*—M. David Shapiro

[57] ABSTRACT

An on board system for determination of slant range to a ground impact point of a ballistic vehicle. The system utilizes two infrared sensors viewing the ground at a very small divergent angle with respect to each other. The off axis displacement angle is small enough to enable viewing of infrared landmarks at low approach angles. The system utilizes a correlator to measure time delay between successive sensings of ground landmarks and slant range is computed without necessity of knowledge of any of the angles involved.

8 Claims, 4 Drawing Figures

PASSIVE OPTICAL PROXIMITY FUZE

FIELD OF THE INVENTION

The invention relates to the use of successive optical viewings of infrared ground landmarks to determine slant range of a ballistic vehicle to the ground impact point.

BACKGROUND OF THE INVENTION

Various fuzing systems have been used to initiate detonation either by measuring the slant range or the vertical distance to ground of a ballistic vehicle approaching a ground target. The most sophisticated of these fuzing systems utilize radar techniques, including active transmitters and associated receivers aboard the vehicle to determine the shortest range to the ground; that is, the vertical altitude. When a predetermined range is measured, the radar receiver outputs a fire pulse signal to detonate the explosive aboard the vehicle. It is well known in the art that a given preselected detonation altitude yields the most efficient operation of the explosive against some ground based targets.

These radar based fuze systems are relatively expensive, require a significant amount of power aboard for their operation and are relatively susceptable to jamming signals. This jamming may cause either premature or negation of firing thus reducing the expected efficacy of the explosive force.

SUMMARY OF THE INVENTION

The foregoing and other shortcomings and problems of the prior art are overcome, in accordance with the present invention, by utilizing a passive system of dual sensors which correlate their infrared responses from the ground in order to determine the time difference between the two times at which the sensors individually sense the same ground landmarks. The responses may be digitized to enable digital data processing.

According to one aspect of the invention, passive infrared sensors are mounted on a ballistic vehicle to sense the passing of landmarks on the ground.

According to another aspect of the invention, the time difference between the sensing of a single ground based landmark is sensed by a pair of passive infrared detectors mounted on the ballistic vehicle. The time difference between the sequential sensor responses is fed, together with velocity information from a velocity sensor, to a data processor on board the ballistic vehicle. The data processor determines the solution for a predetermined mathematical equation yielding the slant range distance to the projected point of impact of the vehicle.

According to still another aspect of the invention, infrared sensitive passive sensors on an airborne ballistic vehicle are utilized to sense the passing of landmarks in the field of view of the sensors in order to determine the slant range distance to the projected point of impact of the vehicle.

The foregoing and other aspects of the present invention will be more fully understood from the following detailed description of an illustrative embodiment of the invention in conjunction with the accompanying drawings, in which.

DETAILED DESCRIPTION OF THE INVENTION

Figure 1:
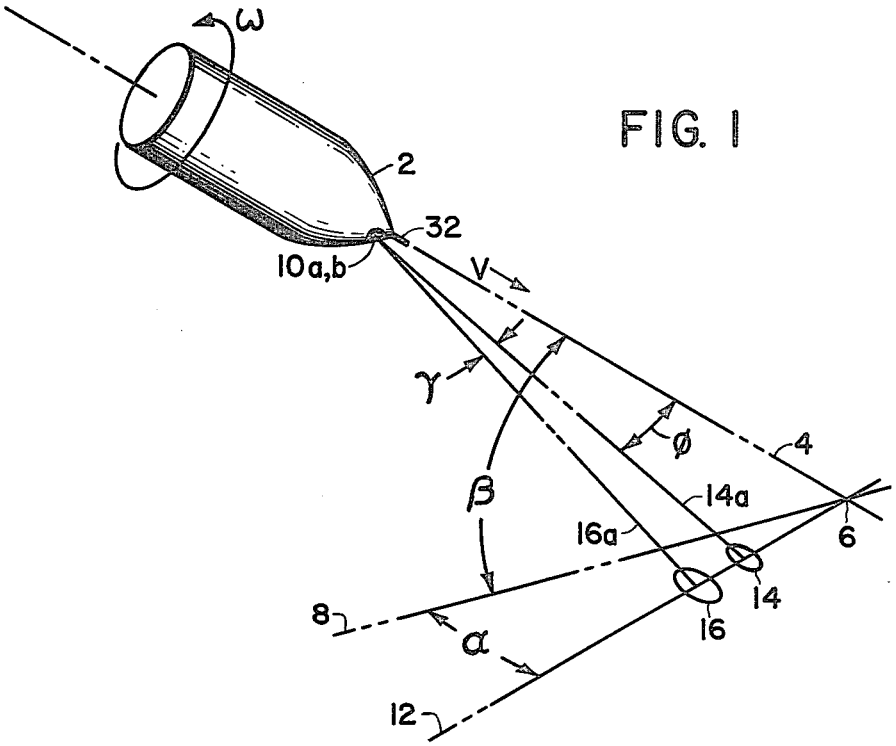
FIG. 1 illustrates the geometry which governs the operation of the apparatus of the invention.

FIG. 1 shows the geometry of the invention which enables it to be used to determine the slant range of ballistic vehicles to projected impact point 6 on the ground. Vehicle 2 is falling on ballistic path 4 to impact point 6 on the ground. Ground path 8 lies vertically below ballistic path 4. Approach angle $\beta$ is the angle between ballistic path 4 and ground path 8. Because vehicle 2 is near the end of flight, it may be assumed that path 4 is straight. Because ballistic vehicle 2 may be rotating at an angular velocity, $\omega$, sensors 10 may in fact be oriented at any angle $\alpha$ with respect to the vertical depending on the roll altitude of vehicle 2. Therefore, field of view track 12 may be at any angle to ground path 8 of vehicle 2. Angle $\phi+\gamma$, the angle between ballistic path 4 and viewpath 16*a* of sensor 10 viewing the ground at field of view 16, is chosen to be less than the smallest angle expected (from ballistic tables) for angle of approach $\beta$ of vehicle 2. In the preferred embodiment of the invention, angle $\phi+\gamma$ is 10°. This assures that, for any angle of roll of vehicle 2, as long as approach angle $\beta$ with respect to the horizontal is more than 10°, sensors 10 will be able to view the ground. The second of two sensors 10 views the ground at 14 along view path 14*a*. The displacement angle $\gamma$ of view path 14*a* from view path 16*a* is very small, being only 4 milliradians, for example. Of course, the magnitude of angle $\gamma$ will affect the time differential between the time when first sensor 10*a* (not separately shown in FIG. 1) views a given landmark on the ground and the time when second sensor 10*b* views the same landmark. The angles given here for $\phi$ and angle $\gamma$ have been determined by considerations of the sizes of landmarks that are expected to be viewed and the expected velocity of the ballistic vehicle.

It is, of course, necessary to the operation of the invention to provide assurance that each of two sensors 10 are sequentially viewing the identical landmark, even though an indefinitly large number of landmarks may be viewed in a single flight. The arithmetic calculation used to determine the slant range of ballistic vehicle 2 to ground target 6 depends on the accuracy of a measured time delay between views of a nearly identical landmark along view paths 14*a* and 16*a*, respectively. The required identity of landmarks is provided by the correlation system (see FIG. 2) of the invention on a continuing basis. Sensor 10*a* (not separately shown in FIG. 1) provides a video output signal which continuously varies depending on the characteristics of the landmarks viewed in area 14*a* as it moves along sensor view path 12. Sensor 10*b* (also not separately shown in FIG. 1) provides a nearly identical video output signal. However, the video output signal from sensor 10*b* is delayed in time from the video output signal from sensor 10*a* as a function of the time delay between the time of viewing of a given landmark by sensors 10*a* and 10*b*. Because vehicle 2 has roll velocity $\omega$, angle $\alpha$ is constantly changing. This means that the time between successive views 14 and 16 of ground landmarks must be short enough to assume significant overlap of the two views of a given landmark to provide the aforementioned correlation.

The delay information is derived for use in solution of the equation:

$$D = TV/[(t_1/t_2)-1] \quad (1)$$

where (see FIG. 3):

D = slant range to impact point 6 from vehicle 2,
V = vehicle velocity along ballistic flight path 4,
$t_1$ = delay between two sensors 10*a* and 10*b* detections of a first landmark, M1,
$t_2$ = delay between two sensors 10*a* and 10*b* detections of a second landmark, M2, and
T = Delay between measurements of $t_1$ and $t_2$.

The equation assumes that each of sensors 10*a* and 10*b* will always be able to view the same sequence of landmarks on the ground. To assume this, it is necessary that two limits be observed. First, the angle $\phi+\gamma$ must never exceed the angle $\beta$. A minimum practical value for angle $\beta$ may be assumed, for example, to be 10°. Since vehicle 2 may roll so that view paths 14*a* and 16*a* of sensors 10 may be in any direction with respect to flight axis 4, it will be apparent that if view angle $\phi+\gamma$ of view path 16*a* equals 10 degrees, view path 16*a* will be parallel to ground track 8 when roll $\omega$ of vehicle 2 places sensors 10 in the maximum upward position with respect to the ground. In this case and in any case where view angle $(\phi+\gamma)$ exceeds 10 degrees, for example, sensor 10*b* looking down sensor view path 16*a* will never see the ground at the zenith of rotational position of sensors 10 on vehicle 2. From a more practical point of view, the system will also fail where view angle $(\phi+\gamma)$ is nearly equal to angle $\beta$ since the range to the ground along path 16*a* will exceed the capability of the system to respond. However, this is not a serious limitation since it is generally reasonable to make angle $(\phi+\gamma)$ significantly less than angle $\beta$.

The second limitation is required as the result of rotation of vehicle 2 around flight path 4. Since only the maximum rotational velocity of vehicle 2 may be predicted, it is imperative that fields of view 14 and 16 be large enough to insure sufficient overlap of successive views 14 and 16 to obtain correlation between them. The system depends on this correlation to determine the time delay between successive detections of a given landmark within fields of view 14 and 16. Of course, it will be recognized that for larger fields of view 14 and 16, less system resolution is available for landmark correlation purposes. A design balance must be struck between desired system resolution and the maximum rotational velocity, $\omega$, expected in vehicle 2.

It is also necessary to consider that if angle $\gamma$ between view paths 14*a* and 16*a* is made too small, the time delay between the sensors will be so short as to represent a problem in terms of adequacy of computation time available for solution of slant range equation (1).

Small angle $\gamma$ between view paths 14*a* and 16*a* assures that relatively short delay times, $t_1$, $t_2$, will be encountered. This means that flight path 4 may be assumed to be a straight line with minimal errors generated over the small time periods involved.

It should be noted that the ground paths of fields of view 14 and 16 always converge to impact point 6. This is true no matter what the attitude of vehicle 2. When vehicle 2 is rotating, the ground paths of fields of view 14 and 16 describe a modified spiral pattern, converging to impact point 6.

Figure 3:
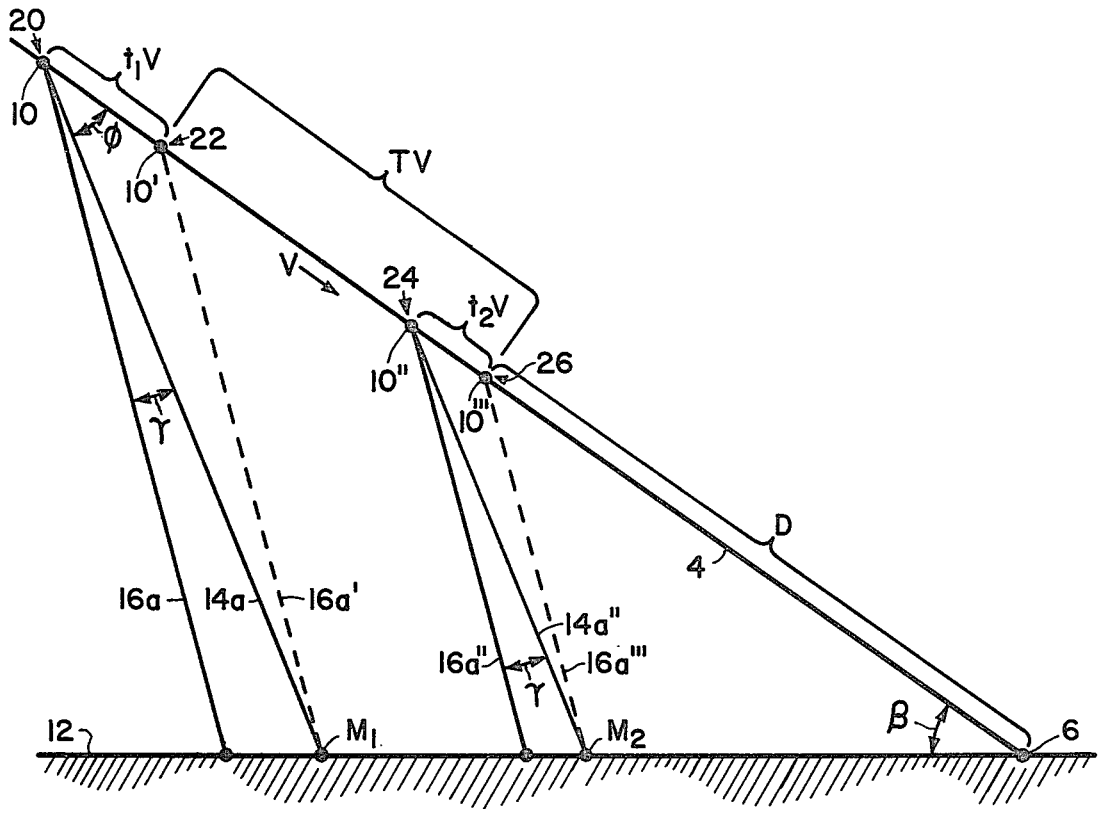
FIG. 3 illustrates the geometry of the invention for four successive positions for the ballistic vehicle and for a two landmark sensing sequence.

Referring, still, to FIG. 3, the derivation of the computation equation is explained as follows:

The distance between point 20, where sensor 10*a* "sees" landmark $M_1$, and point 22, where sensor 10*b* "sees" landmark $M_1$, may be expressed as $t_1V$. The elapsed time is $t_1$, the time between initial site of $M_1$ by sensor 10*a* and the correlation of $M_1$ by site from sensor 10*b*. V is the velocity of vehicle 2 along flight path 4.

Similarly, the distance from point 24 to 26 may be expressed as $t_2V$, the time between successive sites of $M_2$.

T represents the time for vehicle travel between the second sites of $M_1$ and $M_2$ from points 22 and 26.

Because of the similarity of the triangles of FIG. 3, the following ratio relationship holds:

$$(t_1V)/(TV+D) = (t_2V)/D \quad (2)$$

and from (2):

$$(t_1V)/(t_2V) = (TV+D)/D \quad (3)$$
$$= (TV/D)+1$$

cancelling V's and rearranging (3):

$$(t_1/t_2)-1 = (TV)/D \quad (4)$$

yielding:

$$D = TV/[(t_1/t_2)-1] \quad (1)$$

Thus, it can be seen that with the geometry of the invention, it is not necessary to know any of the angles involved in FIG. 3. Assuming straight line flight of ballistic vehicle 2, it is only necessary to determine the correlated delay times, $t_1$, $t_2$, between sensors 10*a* and 10*b* on two successive landmarks, $M_1$, $M_2$, the time between landmarks, T, and the flight path velocity, V, of vehicle 2.

Figure 2:
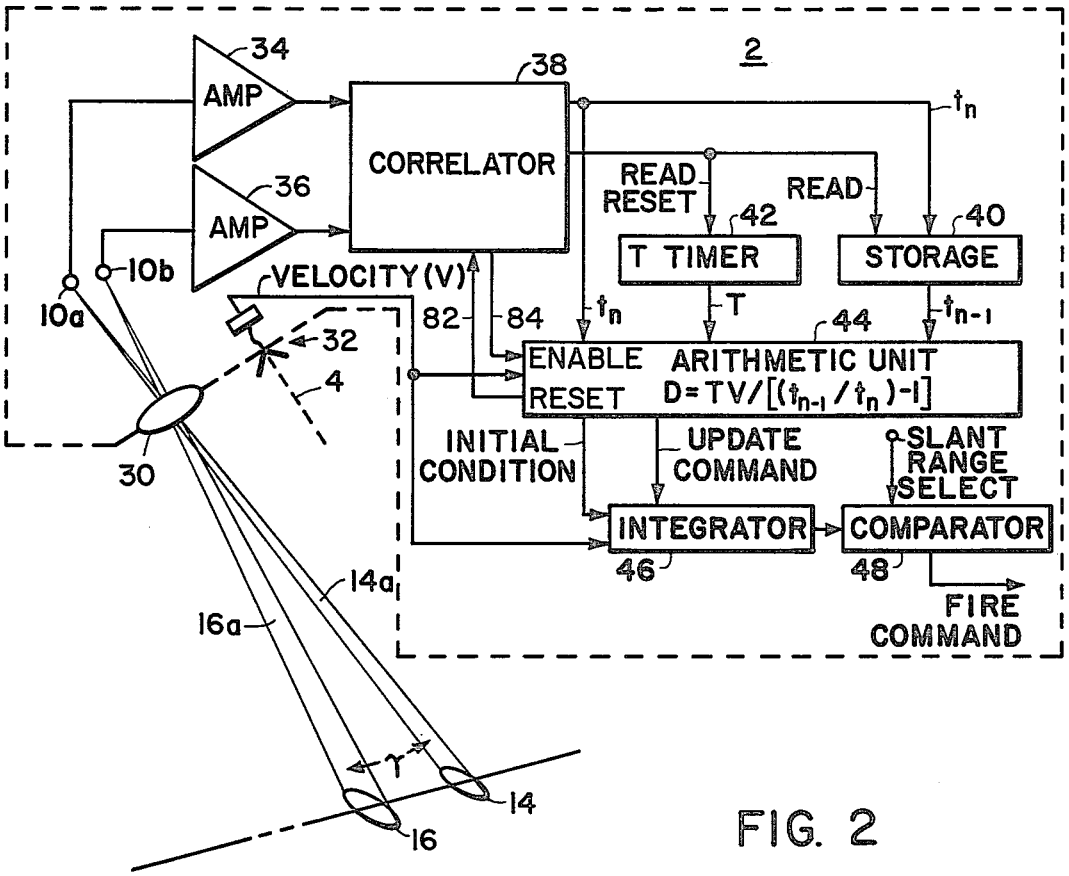
FIG. 2 illustrates one embodiment of the invention in block diagram form.

FIG. 2 shows one embodiment of the invention in schematic and block diagram form. Sensors 10*a* and 10*b* are arranged to view the ground through single lens system 30. This arrangement facilitates precise positioning of view paths 14*a* and 16*a* with respect to each other at angle $\gamma$ and with respect to vehicle 2. Velocity sensor 32 is oriented in vehicle 2 to accomplish air flow speed measurement, V, along flight path 4 of vehicle 2. Sensors 10*a* and 10*b* may be of a lead selenide infrared type, with operation in the 3–5 micron band. They may be cooled thermoelectrically to 228° K with a detectivity, D*, in the range of from $9 \times 10^9$ to $1.5 \times 10^{10}$ $(cm-\sqrt{Hz})/W$ for a 130° field of view and a sensor size of 0.3 mm by 0.3 mm. To realize a system 1° C contrast resolution a D* of $5 \times 10^9$ $(cm-\sqrt{Hz})/W$ is required. The output signals from sensors 10*a* and 10*b* are fed to amplifiers 34 and 46, respectively. Amplifiers 34 and 36 are fed to correlator 38. Correlator 38 provides an output signal, which may be of either digital or analog form, which is proportional to the time shift which yields maximum correlation of the two sensor signals from sensors 10*a* and 10*b*. Upon a first correlation, in correlator 38, time delay $t_{n-1}$, which provided the correlation, is stored in storage device 40. Timer 42 is read and reset at this time. The output of timer 42 is T, the time between adjacent correlations from correlator 38. Correlator 38 also provides an output proportional to $t_n$, the time delay required for subsequent landmark correlation. Comparator 38 may comprise the apparatus of FIG. 4. The output of amplifier 34 (see also, FIG. 2) is fed to threshold detector 60 which is enabled or strobed to sample data by clock signal Cp/M. Signal Cp/M is derived from clock pulse generator 62 which produces clock pulses Cp and divider 64 which divides the pulse rate of clock pulse Cp by M to produce clock pulse Cp/M.

Similarly, threshold detector 66 is fed from amplifier 36. Threshold detectors 60 and 66 produce a "zero" when a minimum difference is not detected between successive samplings of the output signals of amplifier 34 or 36 and a "one" bit when a minimum difference is detected between successive samplings of the output signals of amplifier 34 and 36. Successive output bits from threshold detectors 60 and 66 are fed to M bit shift registers 68, 70, respectively. After M bits are fed to shift register 68 from threshold detector 60, shift register 68 holds M bits for comparison with the bits which have been shifted into shift register 70. Since output bits from threshold detectors 60, 66 are fed to shift registers 68, 70, respectively at a rate determined by the pulse rate of signal Cp/M, the time between input bits may be used to circulate the bits in shift register 70 at an M times higher rate. This is accomplished in the embodiment of FIG. 4 by circulating the bits in shift register 70 at clock signal Cp rate. AND gate 73 is connected to the last bit of shift register 70 by connection 72. AND gate 73 is enabled from connection 77 which is fed by inverter 71. Inverter 71 is fed from clock signal Cp/M. The signal on connection 77 is the binary digital complement of clock signal Cp/M. It is clear then that when a "one" or "true" signal is present in clock Cp/M, AND gate 73 is disabled and connection 75 from AND gate 73 to the input of shift register 70 will be "zero". Connection 75 is combined with the output signal from threshold detector 66 within shift register 70 by "OR" logic (not shown). Therefore, during the strobe time of threshold detector 66, there is an input to shift register 70 which is a function only of the output of threshold detector 66. Additionally, at the time of true clock signal Cp/M, the last bit in shift register 70 is lost since it is inhibited from circulation to the input of shift register 70 by AND gate 73. At all other times, AND gate 73 is enabled by the complement of clock signal Cp/M on connection 77 and the last bit in shift register 70 is allowed to circulate to the input of shift register 70 through AND gate 73. The circulation rate is controlled by clock signal Cp into shift register 70.

Since the digital contents of M bit shift register 70 represents delayed data collected from essentially the same ground landmarks as the data in shift register 68, the aforementioned circulation of data in shift register 70 allows a complete series of comparisons to be made between the contents of shift register 68 and 70 between input clock pulses Cp/M at a rate controlled by clock pulse Cp. Exclusive NOR gates $G_1$ through $G_M$ are used to make simultaneous bit for bit comparisons between the M bit data word storaged in shift register 68 and the circulating data word in shift register 70. This comparison is made in parallel by gates $G_1, G_2 \ldots G_M$, once each 1/Cp clock time so that at the end of period M/Cp all possible combinations of the two data words will have been compared. Since the bit for bit relationship will be essentially random for all comparisons but one, the outputs of gates $G_1, G_2 \ldots G_M$ will be random and when added in summer 74 will produce an output signal at output 76 which is a nominal average value. But in the one case where the position of the circulated data word in shift register 70 corresponds to the time delay between responses from two sensors 10*a, b* (FIG. 2), there will be a higher bit for bit degree of correlation between the data words in shift registers 68 and 70 and in this singular case, the signal at output 76 of summer 74 will demonstrate a marked and recognizable change in level indicating at least partial correlation of the two data words being compared. The degree of bit by bit correlation may, of course, be enhanced by inserting a fixed digital delay in the circuit prior to shift register 68. This delay may correspond to the minimum expected time delay between sensing of a given landmark by two sensors 10*a, b* (FIG. 2). The fixed delay may take the form of additional shift register bits at the input of shift register 68.

Figure 4:
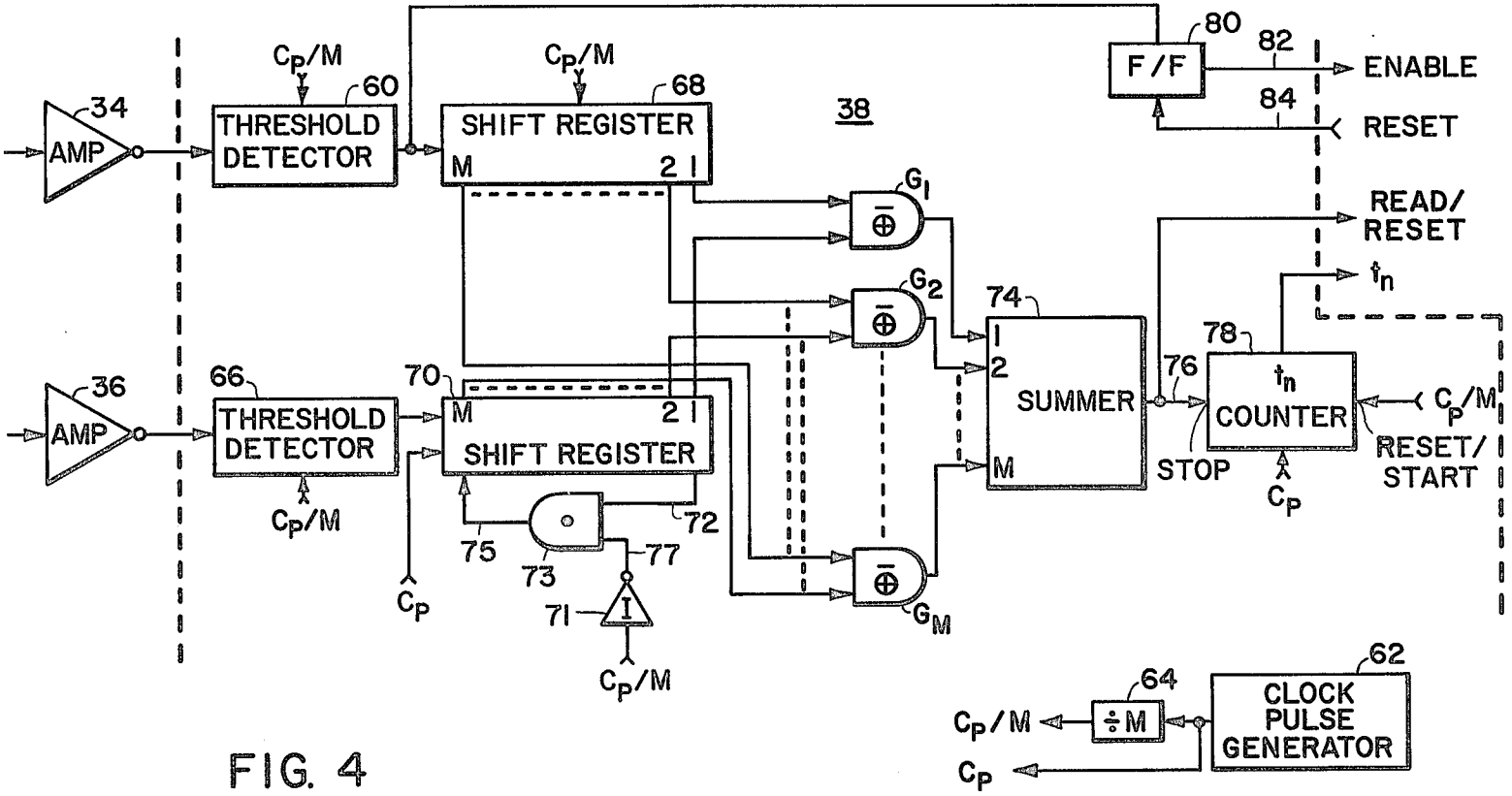
FIG. 4 is a more detailed block diagram of correlator 38 in FIG. 2.

Gates $G_1, G_2 \ldots G_M$ may be of the "Exclusive NOR" type shown in FIG. 4 which provide a "one" output for the case where the two inputs are the same. Alternately, gates $G_1, G_2 \ldots G_M$ may be "Exclusive OR" gates which provide a "one" output in the case where the two inputs are different. Either type may be used since the only requirement is that there be a recognizable change in level at output 76 of summer 74.

$t_n$ counter 78 is started by clock signal Cp/M. It counts clock signal Cp pulses. It is stopped by correlation output 76 signal from summer 74. It will be clear, then, that $t_n$ counter 78 counts the number of clock signal Cp pulses required to shift the data word in shift register 70 into at least partial correlation with the data words in shift register 68. The number of counts of clock signal Cp in $t_n$ timer at the time of correlation is a measure of time delay $t_n$ between the times at which sensors 10*a* and 10*b* see a given landmark (see FIG. 3) such as $M_1$ or $M_2$. ($t_{n-1}$ is, of course, the corresponding time for correlation of a prior observed landmark.)

Cp/M is also used to reset $t_n$ timer 78 to zero after the value of $t_n$ is read out to arithmetic unit 44 and storage unit 40. Output $t_n$ from correlator 38 is fed directly to arithmetic unit 44. Output $t_{n-1}$ from storage device 40 is also fed to arithmetic unit 44. Velocity sensor 30 provides a signal proportional to V, the velocity of vehicle 2 along flight path 4 to arithmetic unit 44. Time, T, is fed to arithmetic unit 44 from timer 42. Arithmetic unit 44 utilizes T, $t_{n-1}$, $t_n$ and V in equation (1):

$$D = TV/[(t_1/t_2)-1] \quad (1)$$

to solve for D, the slant range distance from second landmark correlation point 26 to impact point 6 along path 4 (FIG. 3).

One embodiment of the system of the invention would provide a "one" signal level out of amplifier 34 or 36 when a resolvable temperature differential is detected by sensor 10*a* or 10*b* (respectively). That is, when terrain temperature in field of view 14 or 16 changes by a detectable amount from a prior detected temperature, amplifier 34 or 36 outputs a "one" level digital signal. When there is no such detectable change in temperature, the output of amplifier 34 or 36 is a "zero".

Thus terrain with one detectable temperature irregularity would produce a serial string of logical 0's interrupted by an logic "1" followed by more 0's. $t_n$ is considered equal to the number of time shifts, since the constant of proportionality between time and the number of shifts (the sampling period) divides out in the range equation. To assure against a useless bit-by-bit correlation when no resolvable temperature changes are found by first sensor 10*a*, flip-flop 80 is set if a "1" is detected in any bit of the input to first register 68. If flip-flop 80 is not set the slant range equation calculation is aborted.

If flip-flop 80 is set and a previous $t$ ($t_{n-1}$) exists, then T (time between usable $t$ calculations) timer 42 is stopped and the slant range equation is computed. Flip-flop 80 is then reset by line 84 from arithmetic unit 44 (FIG. 2). These arithmetic operations are well known in the art and are shown in FIG. 2 as the block labelled arithmetic unit 44. The solution of the slant range equation (equation (1), above) may be accomplished by shift registers through a series of add/shift operations for multiplication and substract/shift operations for division. Alternately the arithmetic may be performed by a microcomputer utilizing, for example, a Motorola, Inc. microprocessor unit M6800 chip or chips or their equivalent, and well documented peripheral and memory chips available from that company or from any of several other sources. The output of arithmethic unit 44 updates integrator 46 which provides continuous values of computed slant range. This computed slant range is compared with a preselected range in comparator 48. The preselected slant range is selected manually prior to the flight of vehicle 2. At the end of a range computation, T timer 42 is reset and enabled and the data sampled during processing begins to be processed. Registers just processed are then loaded with updated terrain data and the process repeats.

Various other modifications and changes may be made to the present invention from the principles of the invention described above without departing from the spirit and scope thereof, as encompassed in the accompanying claims.

What is claimed is:

1. An apparatus for determining the slant range from a ballistic vehicle to the ground along the flight path of the ballistic vehicle, comprising in combination:

means for measuring the flight path velocity of the vehicle;

first means for sensing a plurality of landmarks on the ground from the ballistic vehicle, said first sensing means being aimed along a first path, said first path being at a first angle with respect to the vehicle flight path;

second means for sensing said plurality of landmarks on the ground from the ballistic vehicle, said second sensing means being aimed along a second path, said second path being at a second angle with respect to the vehicle flight path, said second angle being greater than said first angle;

means for determining a time delay between said first and said second sensing of one of said plurality of landmarks, as the result of the vehicle motion along the flight path;

means for determining a time between successive sensings of said plurality of landmarks; and means for calculating the slant range from the ground to the ballistic vehicle along the flight path.

2. The apparatus according to claim 1 wherein said first and second sensing means are of a passive type.

3. The apparatus according to claim 2 wherein said passive detectors are of an optical type.

4. The apparatus according to claim 3 wherein said optical sensor means operate in an infrared wavelength region.

5. The apparatus according to claim 4 wherein said means for calculating solves the equation:

$$D = TV/(t_1/t_2 - 1),$$

and where:

D is slant range distance from the ballistic vehicle to ground;

V is the flight path velocity of the ballistic vehicle, $t_1$ is a time between the first means sensing of one of the plurality of landmarks and the second means sensing of said one of the plurality of landmarks, $t_2$ is the time between the first means sensing of another of the plurality of landmarks and the second means sensing of said another of the plurality of landmarks, and T is the time between the measurements $t_1$ and $t_2$.

6. A method for determining the slant range distance from a ballistic vehicle to the ground, comprising the steps of:

sensing a first ground landmark at a first fixed angle with respect to the vehicle flight axis;

sensing said first landmark from a second fixed angle with respect to the vehicle flight axis;

measuring and recording an elapsed time, $t_1$, between said first and second sensing from said first fixed angle and from said second fixed angle of said first landmark;

sensing a second ground landmark from said first fixed angle at a time after said sensing of said first landmark at said first fixed angle;

sensing said second landmark from said second fixed angle;

determining an elapsed time, $t_2$, between said first and second sensings at said first fixed angle and at said second fixed angle of said second landmark;

determining an elapsed time, T, from the time of said sensing of said first landmark from said second fixed angle to the time of said sensing of said second landmark from said second fixed angle;

determining the flight path velocity, V, of the vehicle; and computing the slant range distance, D, from the vehicle to the ground from data including $t_1$, $t_2$, V and T.

7. The method according to claim 6 wherein said computing step is accomplished according to the mathematical equation;

$$D = TV/[(t_1/t_2) - 1].$$

8. The method according to claim 7 wherein said computing step comprises the steps of:

loading a plurality of shift registers with binary digital data representative of the values of $t_1$, $t_2$, V and T;

manipulating said plurality of shift registers to accomplish multiplication by a series of add/shift operations; and manipulating said plurality of shift registers to accomplish division by a series of subtract/shift operations.

* * * * *